United States Patent [19]

Naito et al.

[11] 4,140,871

[45] Feb. 20, 1979

[54] SUSPENSION INSULATORS

[75] Inventors: Katsuhiko Naito, Nagoya; Kenji Sakanishi, Inazawa; Masanori Ito, Ichinomiya, all of Japan

[73] Assignee: NGK Insulators Ltd., Nagoya, Japan

[21] Appl. No.: 835,692

[22] Filed: Sep. 22, 1977

[30] Foreign Application Priority Data

Sep. 28, 1976 [JP] Japan ..... 51-115375

[51] Int. Cl.[2] ..... H01B 17/08; H01B 17/12

[52] U.S. Cl. ..... 714/182; 174/211; 174/212

[58] Field of Search ..... 174/140 C, 182, 189, 174/196, 211, 212

[56] References Cited

FOREIGN PATENT DOCUMENTS 1543444 9/1968 France ..... 174/212

926544 5/1963 United Kingdom ..... 174/182

OTHER PUBLICATIONS

Thomas Insulators Catalog No. 40, The R. Thomas and Sons Co., Lisbon, Ohio, Section A, p. 5, May 1, 1940.

Lantz, A. D., Electrical World, "Develops New Super-Strength Insulator", vol. 161, No. 2, Jan. 13, 1964, p. 70.

*Primary Examiner*—Laramie E. Askin

*Attorney, Agent, or Firm*—Stevens, Davis, Miller & Mosher

[57] ABSTRACT

A suspension insulator having an improved direct current withstand voltage against contamination is provided. The insulator can be obtained by limiting both of the ratio of the surface leakage distance to the shed diameter, and the rib factor to specifically limited values in the ordinary suspension insulator mainly comprising a disk-shaped shed made of an insulating material, a metal cap and a metal pin, said shed being provided at its lower surface with a plurality of ribs arranged concentrically.

4 Claims, 3 Drawing Figures

SUSPENSION INSULATORS

BACKGROUND OF THE INVENTION (1) Field of the Invention

The present invention relates to suspension insulators, more particularly, to suspension insulators suitable to be used in direct current transmission lines.

(2) Background of the Invention

There are used only about 20 direct current transmission lines at present all over the world. However, the direct current transmission line often causes troubles in the flashover of insulator due to contamination thereof. The reason is as follows: The direct current transmission line has a low internal abnormal voltage, and therefore the external insulation of the line is mainly designed based on the withstand voltage of insulators against contamination. However, the direct current withstand voltage of contaminated insulators has not yet hitherto been fully investigated.

That is, in the design of conventional external insulation for direct current transmission line, the following methods have been used, that is, a method, wherein ordinary insulators are merely used, thereby the same surface leakage distance as that in the alternative current transmission is secured in the direct current transmission; a method, wherein the kind and number of insulators to be used are determined based on the assumption that the direct current withstand voltage of a contaminated insulator is the same as the alternative current withstand voltage thereof; and a method, wherein the direct current withstand voltage of a contaminated insulator is measured by the use of a weak test direct current supply source. However, a very important fact has recently been found out from the research for the troubles in the past and from the investigation by the use of a powerful test direct current supply source for a new important direct current transmission line. That is, when an insulator is contaminated in the same degree, the direct current withstand voltage of the contaminated insulator is lower than the alternative current withstand voltage thereof, and the difference between the voltages is larger as the insulator is contaminated more heavily. This is based on the reason that there is no alternation of voltage with respect to time in the direct current contrary to the alternative current, and when a local arc is once formed due to contamination, the arc is apt to grow. Under these circumstances, it has been eagerly demanded to develop an insulator having excellent dimension and size suitable for obtaining a high direct current withstand voltage against contamination.

SUMMARY OF THE INVENTION

The object of the present invention is to provide a suspension insulator having a very high direct current withstand voltage against contamination.

That is, the feature of the present invention is the provision of a suspension insulator mainly comprising a disk-shaped shed made of an insulating material, and a metal cap and a metal pin bonded to the centers of the upper and lower surfaces of the shed, said shed being provided at its lower surface with a plurality of ribs arranged concentrically and made integral therewith, characterized by (1) the ratio of the surface leakage distance to the shed diameter being within the range of from 1.3 to 1.8, preferably from 1.4 to 1.65, and (2) the rib factor defined by the term $$\frac{1}{n-1}\sum_{k=1}^{n-1} S_k/d_k$$

being within the range of from 0.7 to 1.1, preferably from 0.8 to 0.95, wherein $d_k$ represents the length of the segment of a straight line connecting the tip of the kth rib and that of the (k+1)th rib when the ribs are designated successively by 1, 2, 3, . . . k, . . . n from the outermost rib, and $S_k$ represents the length of that segment of a straight line extending in parallel with the axis of the insulator which is located between the midpoint of the former segment and the surface of the insulator.

In the above described insulator of the present invention, the kth rib is preferred to be longer than the (k−1)th and (k+1)th ribs when k is even, and is preferred to be shorter than (k−1)th and (k+1)th ribs when k is odd. Further, it is particularly preferable that the kth rib is longer than the (k+2)th rib in both of the cases wherein k is even or odd.

DESCRIPTION OF THE PREFERRED EMBODIMENTS

The present invention will be explained in more detail with reference to the accompanying drawings.

Figure 1:
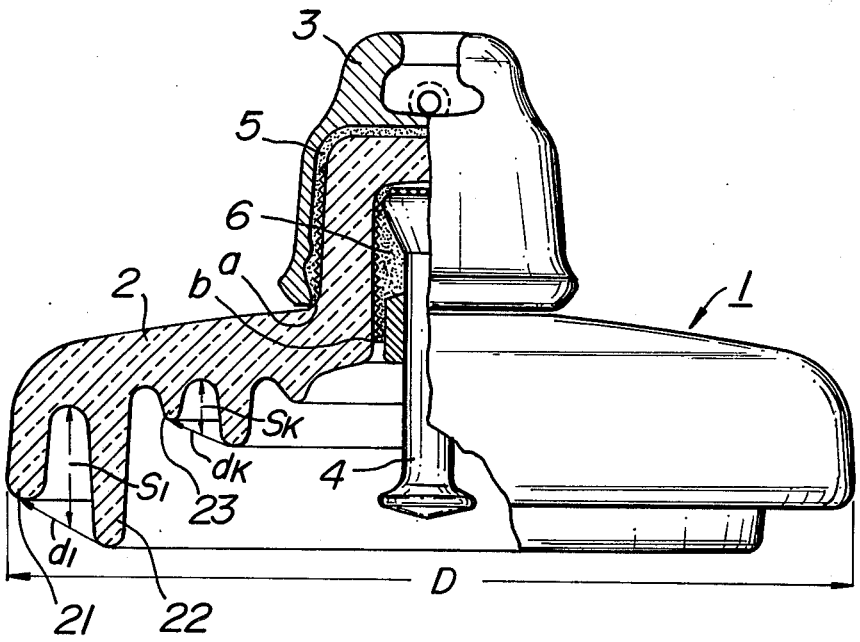
FIG. 1 is a side view of a suspension insulator according to the present invention, the left half of which is shown in section.

Referring to FIG. 1, a suspension insulator 1 generally comprises mainly a disk-shaped shed 2 made of an insulating material, such as porcelain, glass or the like, a metal cap 3 and a metal pin 4. The shed 2 is provided at its lower surface with a plurality of ribs 21, 22, 23, . . . arranged concentrically and made integral therewith. The metal cap 3 and the metal pin 4 are bonded to the centers of the upper and lower surfaces of the shed 2 respectively by means of adhesives, such as cements 5 and 6.

The suspension insulator of the present invention must satisfy the following two conditions in the ordinary suspension insulator 1 having the above described structure.

Figure 2:
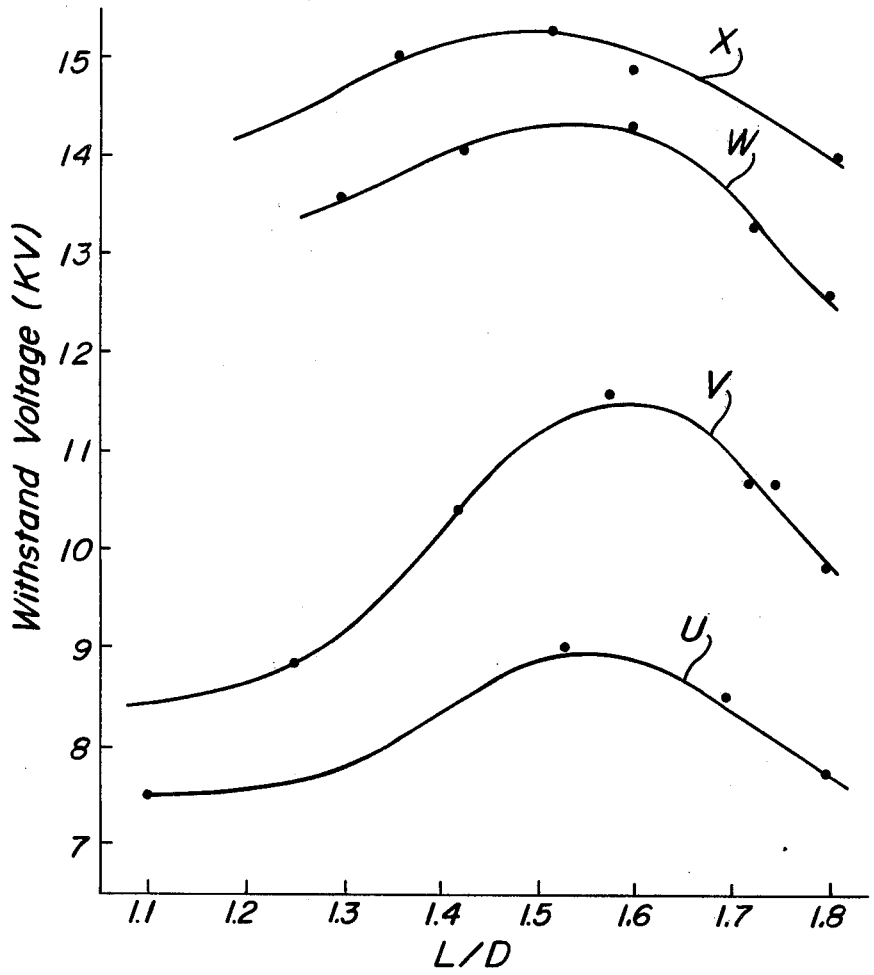
FIG. 2 is a graph illustrating a relation between the ratio of the surface leakage distance L to the shed diameter D of a contaminated insulator and the direct current withstand voltage of the insulator.

First, the L/D ratio must be within the range of from 1.3 to 1.8, wherein L represents the creep distance on the shed 2 between points a and b, at which the shed 2 contacts with the cements 5 and 6 respectively, that is, the surface leakage distance of the insulator, and D represents the shed diameter thereof. In the insulators having substantially the same average diameter, an insulator having a longer surface leakage distance generally has a higher withstand voltage against contamination when the insulator is used for alternative current. However, when the insulator is used for direct current, the insulator does not always exhibit the same tendency as that in alternative current, and has a high withstand voltage against contamination at an L/D ratio within the range of from 1.3 to 1.8 as illustrated in FIG. 2. That is, FIG. 2 shows a relation between the ratio of the surface leakage distance L to the shed diameter D and the direct current withstand voltage of contaminated suspension insulators having various sizes, that is, having different shed diameters. It can be seen from FIG. 2 that, when the L/D ratio is selected within the range of from 1.3 to 1.8, an insulator having the highest direct current withstand voltage against contamination can be obtained. Further, the L/D ratio within the range of from 1.4 to 1.65 is particularly preferable. In FIG. 2, U, V, W and X are direct current withstand voltage curves of contaminated suspension insulators having shed diameters of 254 mm, 320 mm, 400 mm and 420 mm, respectively.

Test insulators are contaminated by a mixture of salt, kaolin and water, in which salt and kaolin are deposited on the surface of the insulators of 0.12 mg/cm$^2$ and 0.1 mg/cm$^2$, respectively.

Figure 3:
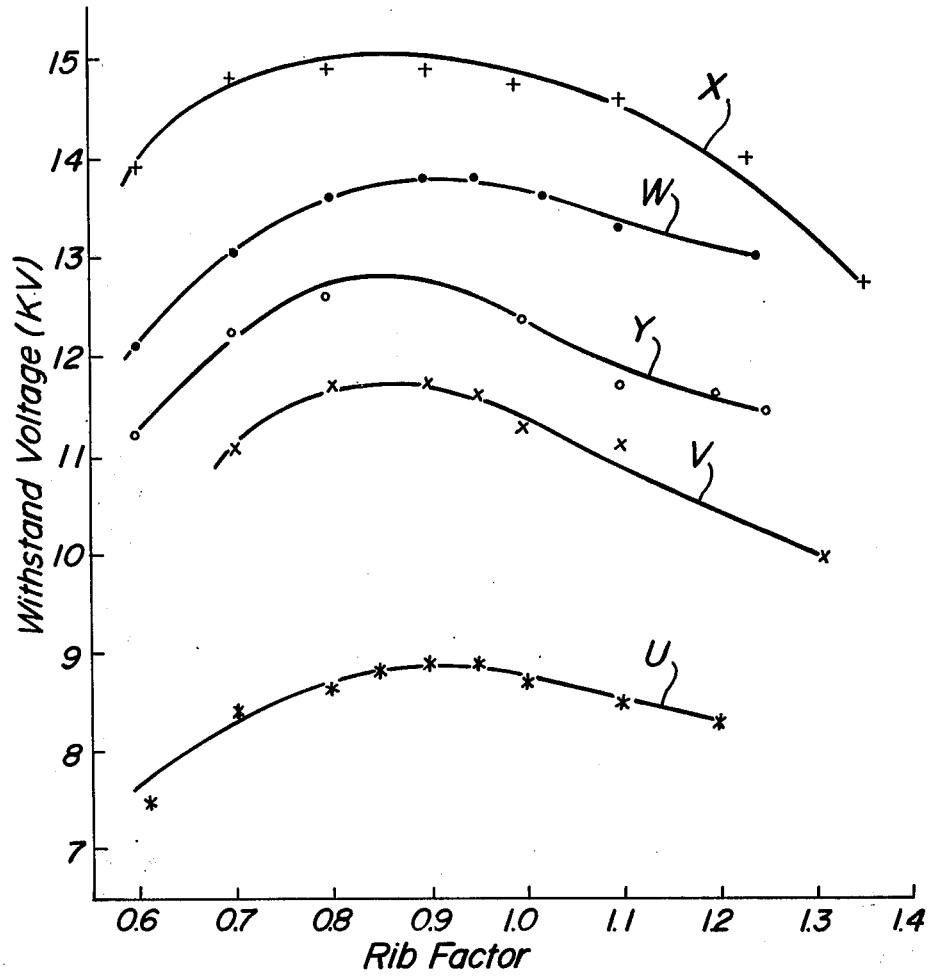
FIG. 3 is a graph illustrating a relation between the rib factor and the direct current withstand voltage of a contaminated insulator.

Second, in the present invention, the rib factor defined by the term $$\frac{1}{n-1}\sum_{k=1}^{n-1} S_k/d_k$$

must be within the range of from 0.7 to 1.1, wherein $d_k$ represents the length of the segment of a straight line connecting the tip of the kth rib and that of the (k+1)th rib, and $S_k$ represents the length of that segment of a straight line extending in parallel with the axis of the insulator which is located between the midpoint of the former segment and the surface of the insulator. The reason is as follows. In the contaminated insulators, the surface leakage distance necessary per each 1 kv of direct current voltage has an intimate relation to the rib factor, and when the rib factor is within the range of from 0.7 to 1.1, the insulator has a high direct current withstand voltage against contamination. FIG. 3 shows the relation between the rib factor and the direct current withstand voltage of a contaminated insulator. In FIG. 3, U, V, Y, W and X are direct current withstand voltage curves of contaminated suspension insulators having shed diameters of 254 mm, 320 mm, 360 mm, 400 mm and 420 mm, respectively. The rib factor is preferred to be within the range of from 0.8 to 0.95.

Further, according to the present invention, in the case where the ribs are designated successively by 1, 2, 3, . . . k, . . . n from the outermost rib, the kth rib is preferred to be longer than the (k−1)th and (k+1)th ribs when k is even, and is preferred to be shorter than (k−1)th and (k+1)th ribs when k is odd. This is based on the reason that there is no alternation of voltage with respect to time in the direct current contrary to the alternative current, and therefore arc is apt grow and a large distance is required between the tips of ribs in order that the surface leakage distance of an insulator is made to act effectively. Further, the kth rib is particularly preferred to be longer than the (k+2)th rib as illustrated in FIG. 1 in both of the cases wherein k is even or odd.

As described above, the suspension insulator of the present invention has a very high direct current withstand voltage against contamination due to the synergistic effect of the above described two conditions, and has an improved liability in the design of the external insulation of direct current transmission line. Moreover, the insulator of the present invention has a high alternative current withstand voltage against contamination. Therefore, the present invention contributes highly to the development of transmission technique.

What is claimed is:

1. A suspension insulator mainly comprising a disk-shaped shed made of an insulating material, and a metal cap and a metal pin bonded to the centers of the upper and lower surfaces of the shed, said shed being provided at its lower surface with a plurality of ribs arranged concentrically and made integral therewith, characterized by (1) the ratio of the surface leakage distance to the shed diameter being within the range of from 1.4 to 1.65, and (2) the rib factor defined by the term $$\frac{1}{n-1}\sum_{k=1}^{n-1} S_k/d_k$$

being within the range of from 0.8 to 0.95, wherein $d_k$ represents the length of the segment of a straight line connecting the tip of the kth rib and that of the (k+1)th rib when the ribs are designated successively by 1, 2, 3, . . . k, . . . n from the outermost rib, and $S_k$ represents the length of that segment of a straight line extending in parallel with the axis of the insulator which is located between the midpoint of the former segment and the surface of the insulator.

2. An insulator according to claim 1, wherein the kth rib is longer than the (k+2)th rib.

3. A suspension insulator mainly comprising a disk-shaped shed made of an insulating material, and a metal cap and a metal pin bonded to the centers of the upper and lower surfaces of the shed, said shed being provided at its lower surface with a plurality of ribs arranged concentrically and made integral therewith, characterized by:

(1) the ratio of the surface leakage distance to the shed diameter being within the range of from 1.3 to 1.8, (2) the rib factor defined by the term $$\frac{1}{n-1}\sum_{k=1}^{n-1} S_k/d_k$$

being within the range of from 0.7 to 1.1, and (3) the kth rib being longer than the (k−1)th and (k+1)th ribs when k is even, and shorter than the (k−1)th and (k+1)th ribs when k is odd, wherein $d_k$ represents the length of the segment of a straight line connecting the tip of the kth rib and that of the (k+1)th rib when the ribs are designated successively by 1, 2, 3, . . . k, . . . n from the outermost rib, and $S_k$ represents the length of that segment of a straight line extending in parallel with the axis of the insulator which is located between the midpoint of the former segment and the surface of the insulator.

4. An insulator according to claim 3, wherein the kth rib is longer than the (k+2)th rib.

* * * * *